US010480791B2

(12) United States Patent
Venkatesan et al.

(10) Patent No.: US 10,480,791 B2
(45) Date of Patent: Nov. 19, 2019

(54) FUEL INJECTOR TO FACILITATE REDUCED $NO_x$ EMISSIONS IN A COMBUSTOR SYSTEM

(71) Applicant: General Electric Company, Schenectady, NY (US)

(72) Inventors: Krishna Kumar Venkatesan, Clifton Park, NY (US); Joel Meier Haynes, Niskayuna, NY (US); Narendra Digamber Joshi, Schenectady, NY (US); David James Walker, Burnt Hills, NY (US); Junwoo Lim, Niskayuna, NY (US); Sarah Marie Monahan, Latham, NY (US)

(73) Assignee: General Electric Company, Schenectady, NY (US)

( * ) Notice: Subject to any disclaimer, the term of this patent is extended or adjusted under 35 U.S.C. 154(b) by 651 days.

(21) Appl. No.: 14/447,967

(22) Filed: Jul. 31, 2014

(65) Prior Publication Data

US 2016/0033132 A1 Feb. 4, 2016

(51) Int. Cl.
*F23R 3/28* (2006.01)
*F23R 3/42* (2006.01)
(Continued)

(52) U.S. Cl.
CPC ..... *F23R 3/286* (2013.01); *F23R 3/10* (2013.01); *F23R 3/34* (2013.01); *F23R 3/42* (2013.01)

(58) Field of Classification Search
CPC ..... F23R 3/42; F23R 3/14; F23R 3/46; F02C 7/222
See application file for complete search history.

(56) References Cited

U.S. PATENT DOCUMENTS 5,487,275 A 1/1996 Borkowicz et al.
6,089,170 A * 7/2000 Conti ..... F23C 7/004 110/262

(Continued)

OTHER PUBLICATIONS

Ryusuke Matsuyama, Masayoshi Kobayashi, Hideki Ogata, Atsushi Horikawa and Yasuhiro Kinoshita, Development of a Lean Staged Combustor for Small Aero-Engines, Proceedings of the ASME Turbo Expo 2012:Turbine Technical Conference and Exposition, vol. 2: Combustion, Fuels and Emissions, Parts A and B Copenhagen, Denmark, Jun. 11-15, 2012. Paper No. GT2012-68272, pp. 211-218. New York, N.Y.: ASME, 2012.

(Continued)

*Primary Examiner* — Arun Goyal
(74) *Attorney, Agent, or Firm* — Joseph Christian

(57) ABSTRACT

A fuel injector to reduce $NO_x$ emissions in a combustor system. The fuel injector including a housing, at least one oxidizer flow path, extending axially through the fuel injector housing and defining therein one or more oxidizer flow paths for an oxidizer stream and a fuel manifold, extending axially through the fuel injector housing and defining therein one or more fuel flow path. The fuel manifold includes a forward portion and an aft portion including an aft face. A plurality of fuel injector outlets are defined in the aft portion, wherein the plurality of fuel injector outlets are configured to inject a fuel flow along a mid-plane of the fuel injector and away from a downstream wall. The fuel flow exiting the fuel manifold undergoes circumferential and radial mixing upon interaction with the oxidizer stream. Additionally disclosed is a combustor system including the fuel injector.

16 Claims, 6 Drawing Sheets

(51) Int. Cl.
*F23R 3/10* (2006.01)
*F23R 3/34* (2006.01)

(56) References Cited

U.S. PATENT DOCUMENTS

| | | | | |
|---|---|---|---|---|
| 6,363,726 | B1 | 4/2002 | Durbin et al. | |
| 7,878,000 | B2 | 2/2011 | Mancini et al. | |
| 7,886,545 | B2 | 2/2011 | Lacy et al. | |
| 7,926,744 | B2 | 4/2011 | Thomson et al. | |
| 8,099,960 | B2 | 1/2012 | Elkady et al. | |
| 2009/0014561 | A1* | 1/2009 | McMasters | B22F 3/225 239/533.12 |
| 2009/0255263 | A1 | 10/2009 | Doerr et al. | |
| 2012/0305673 | A1 | 12/2012 | Matsuyama et al. | |
| 2013/0139511 | A1* | 6/2013 | Sometani | F02C 7/00 60/722 |
| 2014/0053566 | A1 | 2/2014 | Eroglu et al. | |
| 2014/0144144 | A1* | 5/2014 | Hirata | F23R 3/283 60/738 |

OTHER PUBLICATIONS

Kim et al., "An Ultra Low NO(x) Pilot Combustor for Staged Low NO(x) Combustion", ISABE—International Symposium on Air Breathing Engines, 1993, pp. 215-225.

* cited by examiner

FUEL INJECTOR TO FACILITATE REDUCED $NO_x$ EMISSIONS IN A COMBUSTOR SYSTEM

BACKGROUND

The embodiments described herein relate generally to combustion systems, and more specifically, to methods and systems to facilitate optimal mixing of liquid and gaseous fuels with oxidizer in a turbine combustor, such as in a gas turbine engines or liquid fueled aero-engines.

During combustion of natural gas and liquid fuels, pollutants such as, but not limited to, carbon monoxide ("CO"), unburned hydrocarbons ("UHC"), and nitrogen oxides ("$NO_x$") emissions may be formed and emitted into an ambient atmosphere. CO and UHC are generally formed during combustion conditions with lower temperatures and/or conditions with an insufficient time to complete a reaction. In contrast, $NO_x$ is generally formed under higher temperatures. At least some pollutant emission sources include devices such as, but not limited to, industrial boilers and furnaces, larger utility boilers and furnaces, liquid fueled aero-engines, gas turbine engines, steam generators, and other combustion systems. Because of stringent emission control standards, it is desirable to control $NO_x$ emissions by suppressing the formation of $NO_x$ emissions.

To increase the operating efficiency, at least some known turbine engines, may operate with increased combustion temperatures. Generally, in at least some of such known engines, engine efficiency increases as combustion temperatures increase. However, as previously alluded to, operating known turbine engines with higher temperatures may also increase the generation of polluting emissions, such as oxides of nitrogen ($NO_x$). In an attempt to reduce the generation of such emissions, at least some known turbine engines include improved combustion system designs. For example, many combustion systems may use premixing technology that includes fuel injection nozzles or micromixers that mix substances, such as diluents, gases, and/or air with fuel to generate a fuel mixture for combustion. Future $NO_x$ emissions targets appear unattainable with current injectors without design changes.

Other known combustor systems implement lean-premixed combustion concepts and attempt to reduce $NO_x$ emissions by premixing a lean combination of fuel and air prior to channeling the mixture into a combustion zone defined within a combustion liner. In this type of combustor system, a primary fuel-air premixture is generally introduced within the combustion liner at an upstream end of the combustor and a secondary fuel-air premixture may be introduced towards a downstream exhaust end of the combustor.

It should be appreciated that the above-described combustor systems include fuel injectors that typically rely on a jet-in, cross flow type of injection from limited number of orifices along one axial plane on a centerbody of the fuel injector. In many instances, the orifice counts are restricted to achieve sufficient penetration to meet mixing and efficiency targets. This means, higher supply pressure for the fuel and a resultant fuel wall wetting due to injection being from the centerbody. In addition, these conventional fuel injectors typically have a low operability range owing to variability in fuel jet penetration. In addition, these known injectors will have higher auto-ignition risks when operating at high operating pressure ratios (OPRs).

As a result, intricate assembly methods are often required to meet specified performance criteria. As such, a need exists for an advanced fuel injector, preferably for use in an aero-engine application that facilitates optimal mixing of liquid and/or gaseous fuels with oxidizer in a turbine combustor, resulting in reduced $NO_x$ emissions.

BRIEF DESCRIPTION

In one aspect, a fuel injector for use in a fuel injection nozzle is provided. The fuel injector comprises a fuel injector housing, at least one oxidizer flow path, and a fuel manifold. The fuel injector housing comprises an upstream face, an opposite downstream face, and a peripheral wall extending therebetween. The at least one oxidizer flow path extends axially through the fuel injector housing and defines therein one or more oxidizer flow paths for an oxidizer stream. The fuel manifold extends axially through the fuel injector housing and defines therein one or more fuel flow paths. The fuel manifold comprises a forward portion and an aft portion including an aft face and a plurality of fuel injector outlets defined in the aft portion. The plurality of fuel injector outlets are configured to inject a fuel flow along a mid-plane of the fuel injector and away from a downstream wall. Furthermore, the fuel flow exiting the fuel manifold undergoes circumferential and radial mixing upon interaction with the oxidizer stream.

In another aspect, an alternate embodiment of a fuel injector for use in a fuel injection nozzle is provided. The fuel injector comprises a fuel injector housing, at least one oxidizer flow path, and a fuel manifold. The fuel injector housing comprises an upstream face, an opposite downstream face, and a peripheral wall extending therebetween. The at least one oxidizer flow path extends axially through the fuel injector housing and defining therein one or more oxidizer flow paths for an oxidizer stream. The fuel manifold extends axially through the fuel injector housing and defining therein one or more fuel flow paths. The fuel manifold comprises a forward portion and an aft portion including an aft face and a plurality of fuel injector outlets configured circumferentially spaced about at least one of a sidewall defining the aft portion of the fuel manifold or circumferentially spaced about an aft face of the aft portion of the fuel manifold. The plurality of fuel injector outlets are configured to inject a fuel flow along a mid-plane of the fuel injector and away from a downstream wall and provide circumferential and radial mixing upon interaction of the injected fuel flow with the oxidizer stream.

In yet another aspect, a combustor system is provided. The combustor system comprises a combustion liner and a plurality of fuel injectors. The combustion liner comprises a center axis, an outer wall, a first end, and a second end with the outer wall is orientated substantially parallel to the center axis. The plurality of fuel injectors are coupled adjacent to the liner first end. Each of the plurality of fuel injectors comprises a fuel injector housing, at least one oxidizer flow path and a fuel manifold. The fuel injector housing comprises an upstream face, an opposite downstream face, and a peripheral wall extending therebetween. The at least one oxidizer flow path, extends axially through the fuel injector housing and defines therein one or more oxidizer flow paths for an oxidizer stream. The fuel manifold extends axially through the fuel injector housing and defines therein one or more fuel flow paths. The fuel manifold comprises a forward portion and an aft portion including an aft face and a plurality of fuel injector outlets defined in the aft portion. The plurality of fuel injector outlets are configured to inject a fuel flow along a mid-plane of the fuel injector and away from a downstream wall. The fuel flow exiting the fuel manifold undergoes circumferential and radial mixing upon interaction with the oxidizer stream.

DETAILED DESCRIPTION

The exemplary methods and systems described herein overcome the structural disadvantages of known combustors by providing optimal mixing of liquid and/or gaseous fuels with oxidizer in the combustor. It should also be appreciated that the term "first end" is used throughout this application to refer to directions and orientations located upstream in an overall axial flow direction of combustion gases with respect to a center longitudinal axis of a combustion liner. It should be appreciated that the terms "axial" and "axially" are used throughout this application to refer to directions and orientations extending substantially parallel to a center longitudinal axis of a combustion liner. It should also be appreciated that the terms "radial" and "radially" are used throughout this application to refer to directions and orientations extending substantially perpendicular to a center longitudinal axis of the combustion liner. It should also be appreciated that the terms "upstream" and "downstream" are used throughout this application to refer to directions and orientations located in an overall axial flow direction With respect to the center longitudinal axis of the combustion liner.

Figure 1:
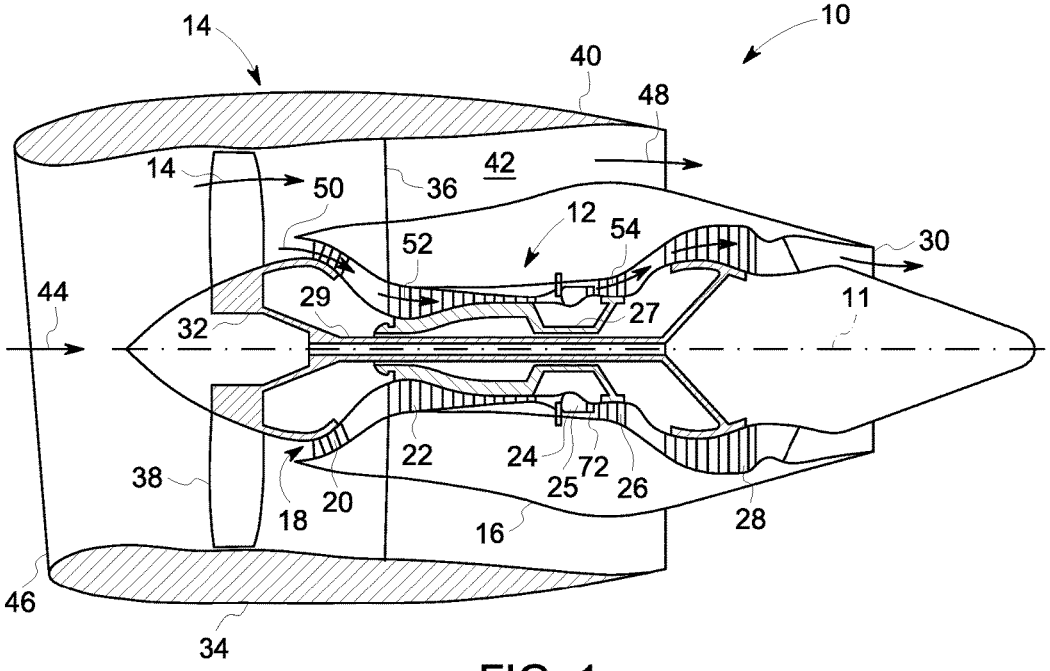
FIG. 1 is schematic diagram of an exemplary turbine engine assembly, according to one or more embodiments disclosed herein.

Referring now to the drawings in detail, wherein identical numerals indicate the same elements throughout the figures, FIG. 1 depicts in diagrammatic form an exemplary turbine engine assembly 10 (high bypass type engine) utilized with aircraft having a longitudinal or axial centerline axis 11 therethrough for reference purposes. Assembly 10 preferably includes a core turbine engine generally identified by numeral 12 and a fan section 14 positioned upstream thereof. Core engine 12 typically includes a generally tubular outer casing 16 that defines an annular inlet 18. Outer casing 16 further encloses and supports a booster compressor 20 for raising the pressure of the air that enters core engine 12 to a first pressure level. A high pressure, multi-stage, axial-flow high pressure compressor 22 receives pressurized air from booster 20 and further increases the pressure of the air. The pressurized air flows to a combustor 24, generally defined by a combustion liner 25, where fuel is injected into the pressurized air stream to raise the temperature and energy level of the pressurized air. The high energy combustion products flow from combustor 24 to a first (high pressure) turbine 26 for driving high pressure compressor 22 through a first (high pressure) drive shaft 27, and then to a second (low pressure) turbine 28 for driving booster compressor 20 and fan section 14 through a second (low pressure) drive shaft 29 that is coaxial with first drive shaft 27. After driving each of turbines 26 and 28, the combustion products leave core engine 12 through an exhaust nozzle 30 to provide propulsive jet thrust.

Fan section 14 includes a rotatable, axial-flow fan rotor 32 that is surrounded by an annular fan casing 34. It will be appreciated that fan casing 34 is supported from core engine 12 by a plurality of substantially radially-extending, circumferentially-spaced outlet guide vanes 36. In this way, fan casing 34 encloses the fan rotor 32 and a plurality of fan rotor blades 38. A downstream section 40 of fan casing 32 extends over an outer portion of core engine 12 to define a secondary, or bypass, airflow conduit 42 that provides additional propulsive jet thrust.

From a flow standpoint, it will be appreciated that an initial air flow, represented by arrow 44, enters the turbine engine assembly 10 through an inlet 46 to fan casing 32. Air flow 44 passes through fan blades 38 and splits into a first compressed air flow (represented by arrow 48) and a second compressed air flow (represented by arrow 50) which enters booster compressor 20. The pressure of the second compressed air flow 50 is increased and enters high pressure compressor 22, as represented by arrow 52. After mixing with fuel and being combusted in combustor 24, combustion products 54 exit combustor 24 and flow through the first turbine 26. Combustion products 54 then flow through the second turbine 28 and exit the exhaust nozzle 30 to provide thrust for the turbine engine assembly 10.

Figure 2:
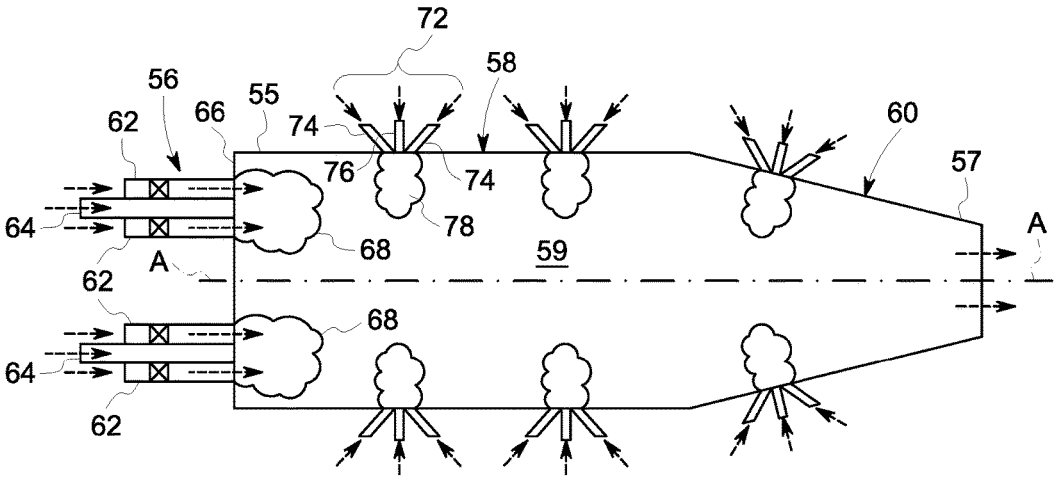
(Prior Art) FIG. 2
FIG. 2 is a schematic illustration of an exemplary known low NOx combustor that may be used with the combustion section shown in FIG. 1, according to one or more embodiments disclosed herein.

FIG. 2 is a schematic illustration of an exemplary known low $NO_x$ combustor that has been designed in an attempt to minimize $NO_x$ emissions. More particularly, illustrated is a known combustor 24 that includes a plurality of premixing injectors 56, a combustion liner 58 having a center axis A-A, and a transition piece 60. Each premixing injector 56 includes a plurality of annular swirl vanes and fuel spokes (not shown) that are configured to premix compressed air and fuel entering through an annular inlet 62 and an annular fuel centerbody 64, respectively.

Known premixing injectors 56 are generally coupled to an end cap 66 of combustor 24. In the exemplary embodiment, four premixing injectors 56 are coupled to end cap 66. A first end 55 of the combustion liner 58 is coupled to the end cap 66 such that combustion liner 58 may receive a fuel-air premixture injected from premixing injectors 56 and burn the mixture in local flame zones 68 defined within a combustion chamber 59 defined by combustion liner 58. A second end 57 of the combustion liner 58 is coupled to a first end of the transition piece 60. During operation, the transition piece 60 channels the combustion towards a turbine section, such as toward the first and second turbines 26, 28 (shown in FIG. 1).

Local areas of low velocity are known to be defined within the combustion chamber 59 and along liner inner surfaces of liner 58 during operation. For example, swirling air is channeled from premixing injectors 56 into the larger combustion liner 58 during operation. At the area of entry into combustion liner 58, swirling air is known to radially expand in the combustion liner 58. The axial velocity at the center of the combustion liner 58 is reduced. Such combustor local areas of low velocity may be below the flame speed for a given fuel/air mixture. As such, pilot flames in such areas may flashback towards areas of desirable fuel-air concentrations as far upstream as the low velocity zone will allow, such as, but not limited to, areas within premixing injectors 56. As a result of flashback, premixing injectors 56 and/or other combustor components may be damaged and/or the operability of combustor 24 may be compromised.

Sufficient variation in premix fuel/air concentration in combustion liner 58 may also result in combustion instabilities resulting in flashback into premixing injectors 56 and/or in higher dynamics as compared to a more uniform premix fuel/air concentration. Also, local areas of less uniform fuel and air mixture within combustor 24 may also exist where combustion can occur at near stoichiometric temperatures in which $NO_x$ may be formed.

In the exemplary embodiment, combustor 24 also includes a plurality of axially-staged injectors 64 that are coupled along both combustion liner 28 and transition piece 30. It should be appreciated that injectors 72 may be coupled along either the combustion liner 58 and/or along the transition piece 60. Each injector 72 includes any number of air injectors 74 and corresponding fuel injectors 76 oriented to enable direct injection of air and direct injection of fuel, such that a desired fuel-air mixture is formed within combustion liner 58 and/or transition piece 60. In an embodiment, air and fuel injectors 74 and 76 of a respective injector 72 are coaxially aligned to facilitate the mixing of air and fuel flows after injection into combustion liner 58 and/or transition piece 60. The flow of air and fuel injected by each injector 72 is directed towards a respective local flame zone 78 to facilitate stabilizing lean premixed turbulent flames defined in local premixed flame zones 68. Any number of injectors 72, air and fuel injectors 74 and 76, and/or air and fuel injection holes (not shown) of various sizes and/or shapes may be coupled to, or defined within combustion liner 58 and/or transition piece 60 to enable a desirable volume of air and to be channeled towards specified sections and/or zones defined within combustor 24.

By combining premixing injectors 56 and axially-staged injectors 72, known combustor 24 facilitates controlling turndown and/or combustor dynamics, while also facilitating reducing overall $NO_x$ emissions. While combustor 24 may increase the efficiency and operability of a turbine containing such systems, certain drawbacks remain. For example, as previously indicated, the combustor systems of FIG. 2 includes fuel injectors that typically rely on a jet-in, cross flow type of injection from a limited number of orifices along an axial plane on a centerbody of the fuel injector. In many instances, the orifice counts are restricted to achieve sufficient penetration to meet mixing and efficiency targets. As a result of such restriction, higher supply pressure for the fuel are required and result in fuel wall wetting due to injection being from the centerbody. This fuel wall wetting may result in higher auto-ignition risks when operating at high operating pressure ratios (OPRs). In addition, these known fuel injectors typically have a low operability range owing to variability in fuel jet penetration.

Figure 3:
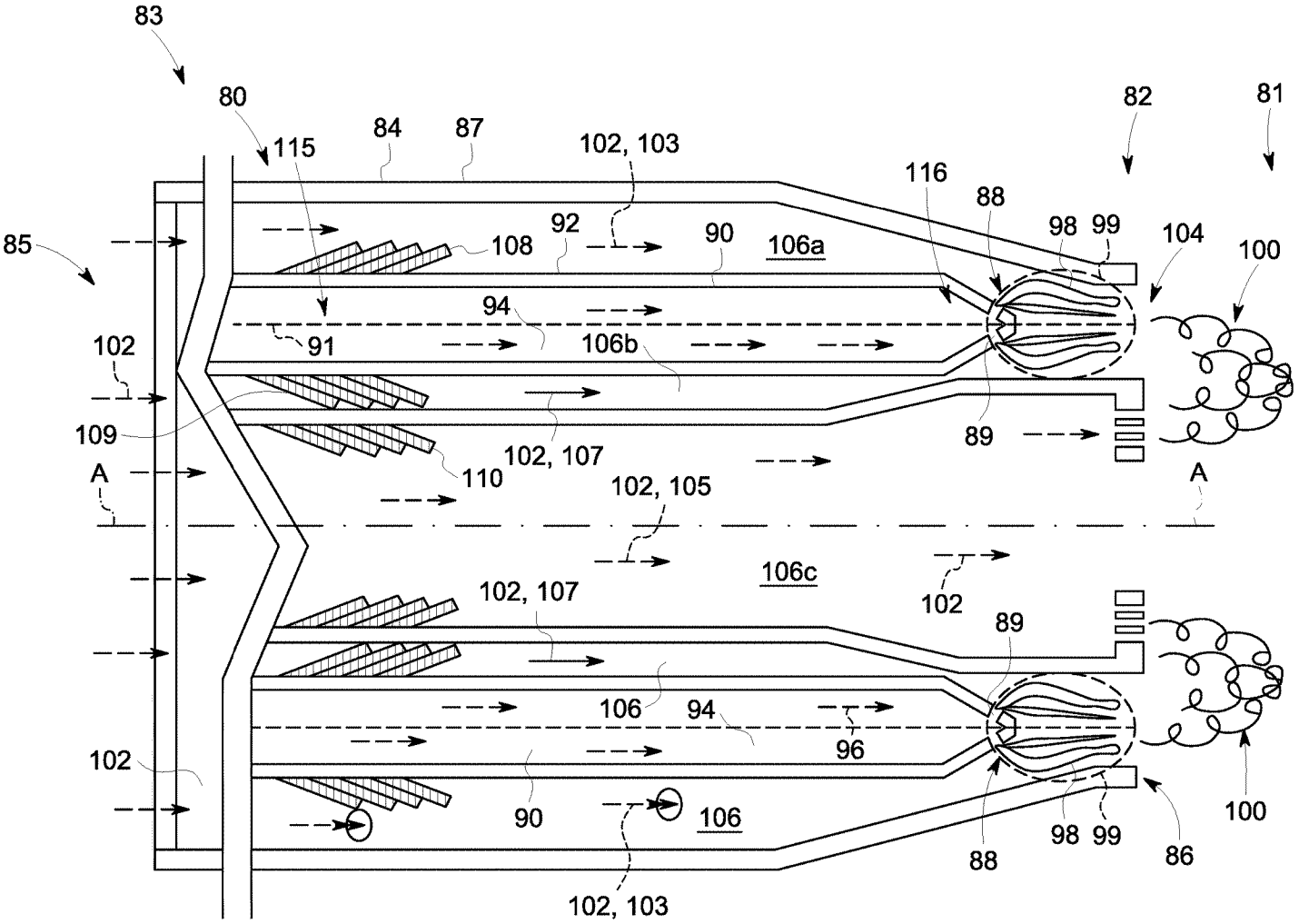
FIG. 3 is a enlarged cross-sectional schematic view of an exemplary combustor that may be used with the turbine combustion section shown in FIG. 1, according to one or more embodiments disclosed herein.

Referring now to FIG. 3, illustrated is a portion of a novel low NOx combustor assembly 80, and more particularly a portion of a fuel nozzle 82 including a plurality of fuel injectors, according to this disclosure and that may be used with the turbine engine assembly 10 (shown in FIG. 1). FIGS. 4-7 disclose alternate embodiments of the fuel injection nozzle, and more particularly fuel injector, that may be used with the turbine engine shown in FIG. 1. Referring again to FIG. 3, the combustor assembly 80 includes a combustion liner having a forward end, generally indicated by arrow 83 and an aft end, generally indicated by arrow 81. As illustrated an aft positioned fuel injection nozzle 82 includes a housing 84 having a center axis A-A that extends generally parallel with a main axis, X-X of FIG. 1 of the engine. The fuel injector housing 84 comprising an upstream face 85, an opposite downstream face 86, and a peripheral wall 87 extending therebetween. A plurality of injectors 88 are configured in fluid communication with a fuel manifold 90 defined by a fuel housing 92 and including a forward portion 115 and an aft portion 116. The fuel manifold 90 comprises one or more flow paths 94 via which a fuel stream 96 is provided, as indicated by directional arrows in FIG. 3. The fuel manifold 90 design is optimized such that the fuel stream 96 is injected via the plurality of injectors 88, and more particularly via a plurality of fuel injector outlets 89 defined in an aft portion 116 of the fuel manifold 90, in a fuel injection flow path 98 away from a liner wall (not shown) of a downstream combustor and at target location.

During operation of the fuel injection nozzle 82, the fuel stream 96 is injected via the plurality of fuel injector outlets 89, axially, along a mid-plane, indicated at 91, of the fuel injector 88 and downstream combustor (not shown) and away from any downstream wall, thus the potential for fuel wetting the wall is considerably reduced. In an alternate embodiment, the fuel injection may be staged between the axial mid plane 91 and the fuel injector outlet 89 at various engine operation conditions. In addition, the fuel injector 88 may further be independently metered and controlled. Moreover, the fuel injection location is optimized to produce high mixing efficiency at an exit plane 104 of the nozzle.

In an embodiment, an oxidizer flow stream, as indicated by directional arrows 102, may be optimized by splitting the oxidizer flow stream 102 and diverting the split oxidizer stream into multiple oxidizer flow paths, and more particularly, into an outer oxidizer flow path **106*a*, an intermediate oxidizer low path 106*b*, and an inner oxidizer flow path 106*c* via outer, intermediate and inner swirl vanes, and more particularly, via an outer swirler 108, an intermediate swirler 109 and an inner swirler 110, respectively. The swirlers 108, 109, 110 employed for the various flow paths may be radial swirlers, axial swirlers or any combination of radial and axial swirlers. In an embodiment, injection of the fuel stream 96 may occur at multiple oxidizer flow paths 106*a*, 106*b*, 106*c* to ensure optimal mixing. In addition, in an embodiment the fuel passage 94 in the fuel manifold 90 may have swirl vanes (not shown) to impart a swirling motion to the fuel stream 96 before it is supplied to the injectors 88. Beneficially the fuel stream 96 is provided to the injectors 88 with a uniform distribution. In an embodiment, the fuel injection flow paths 98 are configured such that the fuel flow stream 96 exiting the fuel manifold 90 undergoes initial mixing (as indicated by highlighted area 99) with an outer portion of the oxidizer flow stream 102 passing through the outer swirler 108, and more particularly, an outer oxidizer flow stream 103, and an intermediate portion of the oxidizer flow stream 102 passing through the intermediate swirler 109, and more particularly, an intermediate oxidizer flow stream 107 and then undergoes circumferential and radial mixing 100 upon its interaction with an inner portion of the oxidizer flow stream 102 passing through the inner swirler 110, and more particularly, an inner oxidizer flow stream 105**.

Design optimized embodiments of the fuel nozzle 92, and more particularly the fuel injector 88 and associated manifold internal flow paths 94, are described below and may include, but are not limited to, the location of various fuel orifices/sheet streams, exit angles of the fuel stream(s), exit dimensions of the various fuel orifices and annulus, shape of fuel orifices, residence time of fuel and air mixture, number fuel streams exiting the manifold.

Figure 4:
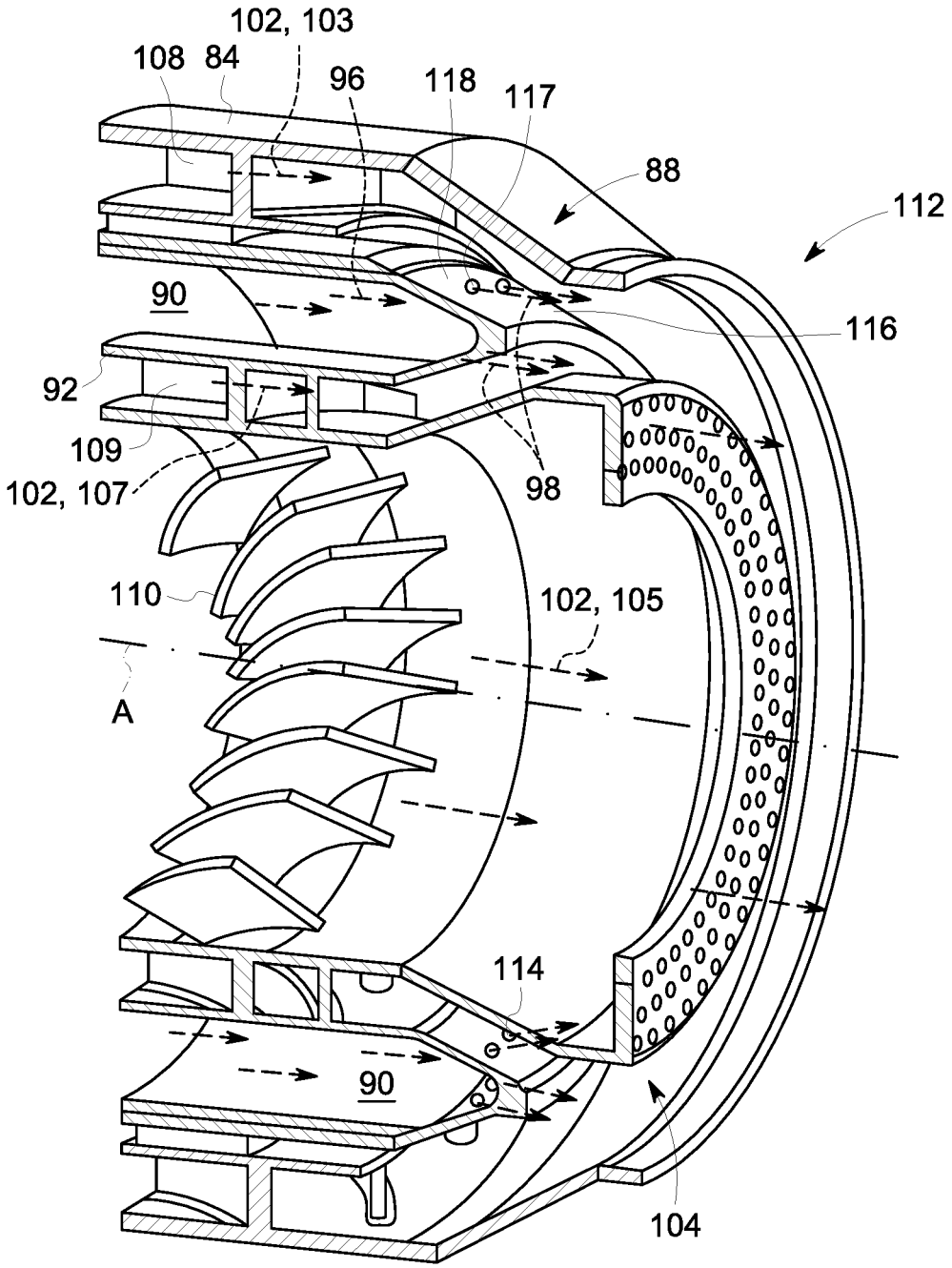
FIG. 4 is a perspective view of a portion of an exemplary fuel injection nozzle including fuel injectors that may be used with the turbine engine shown in FIG. 1, according to one or more embodiments disclosed herein.

Referring now to FIGS. 4-7, as previously stated, provided are alternative configurations for the fuel injectors 88 of the fuel injection nozzle 82. Components in FIGS. 4-7 that are identical to components of FIG. 3 are identified in FIGS. 4-7 using the same reference numerals used in FIG. 3. Referring more specifically to FIG. 4, illustrated in an enlarged perspective view is a portion of a fuel injection nozzle 112, generally similar to fuel injection nozzle 82 of FIG. 3. In this particular embodiment, fuel injection nozzle 112 includes a housing 84 having a center axis A-A that extends generally parallel with a main axis, X-X of FIG. 1 of the engine. A plurality of fuel injector outlets 89 are configured in fluid communication with a fuel manifold 90 defined by a fuel housing 92. The fuel manifold 90 comprises a flow path 94 via which a fuel stream 96 is provided as indicated by directional arrows. The fuel manifold 90 design is optimized such that the fuel stream 96 that is injected via the plurality of injectors 88, and more particularly the plurality of fuel injector outlets 89, is away from a liner wall (not shown) of a downstream combustor and at target location.

In this particular embodiment, the injector 88 is configured including a plurality of orifices, including intermediate orifices 114 and a plurality of outer orifices 117, defined circumferentially about the aft portion 116 of the fuel manifold 90. More particularly, the plurality of orifices 114, 117 are defined circumferentially spaced about a sidewall 118 defining the aft portion of the fuel manifold. In this particular embodiment, the sidewall 118 is configured angled in a downstream direction. The plurality of fuel orifices 114 are configured to provide injection of the fuel stream 96 into the intermediate oxidizer flow stream 107 along a mid-plane of a downstream combustor (not shown). The plurality of fuel orifices 117 are configured to provide injection of the fuel stream 96 into the outer oxidizer flow stream 103 along a mid-plane of a downstream combustor (not shown).

During operation of the fuel nozzle 112, the fuel stream 96 is injected into the outer oxidizer flow stream 103 and the intermediate oxidizer flow stream 107, and into a downstream combustor (not shown) and away from any downstream wall, thus the potential for fuel wetting the wall is considerably reduced. Moreover, the plurality of orifices 114, 117 are optimized such that the fuel flow 98 exiting the fuel manifold 90 undergoes initial mixing with the outer oxidizer flow stream 103 and the intermediate oxidizer flow stream 107 and subsequent circumferential and radial mixing upon its interaction with the inner oxidizer flow stream 105, thereby producing high mixing efficiency at an exit plane 104 of the nozzle 112.

Figure 5:
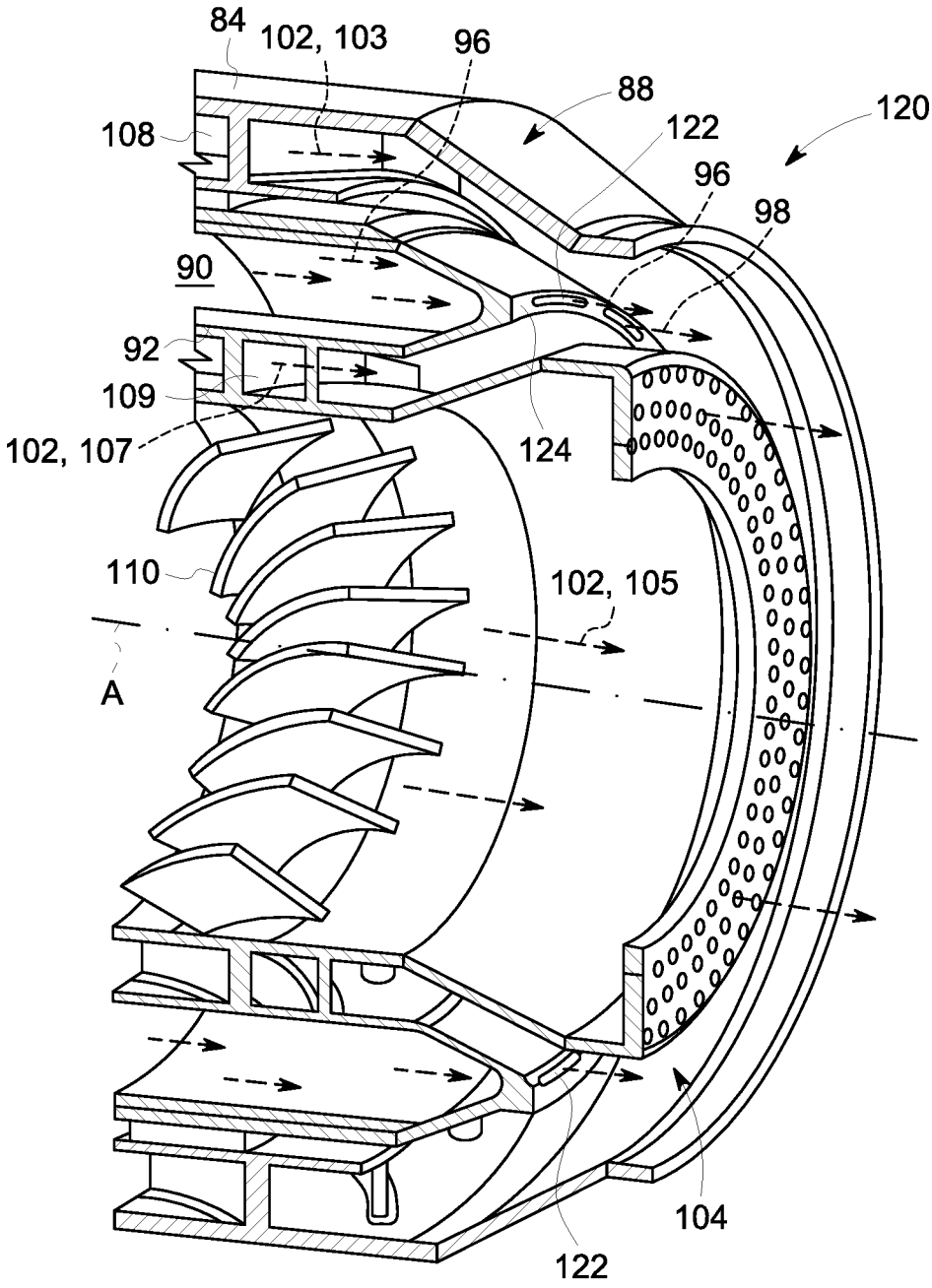
FIG. 5 is a perspective view of a portion of an alternate embodiment of an exemplary fuel injection nozzle including fuel injectors that may be used with the turbine engine shown in FIG. 1, according to one or more embodiments disclosed herein.

In an alternate embodiment, such as illustrated in FIG. 5, a fuel injection nozzle 120, generally similar to fuel injection nozzle 82 of FIG. 3, is illustrated and includes a fuel injector 88 configured including a plurality of slots 122 defined circumferentially about an aft portion 116 of the fuel manifold 90. In contrast to the previous embodiment of FIG. 4, in this particular embodiment, the fuel injection occurs at an aft face 124 of the aft portion 116 of the fuel manifold 90. The plurality of slots 122 are configured to provide initial injection and mixing of the fuel stream 96 into and with the outer oxidizer flow stream 103 and the intermediate oxidizer flow stream 107 and subsequently injection and mixing into and with the inner oxidizer flow stream 105, along a mid-plane of a downstream combustor (not shown) and away from any downstream wall, thus the potential for fuel wetting the wall is considerably reduced. Similar to the previously described embodiments, the plurality of slots 122 are optimized such that the fuel flow 98 exiting the fuel manifold 90 undergoes initial mixing with the outer oxidizer flow stream 103 and the intermediate oxidizer flow stream 107 and subsequent circumferential and radial mixing upon its interaction with the inner oxidizer flow stream 105, thereby producing high mixing efficiency at an exit plane 104 of the nozzle 120.

Figure 6:
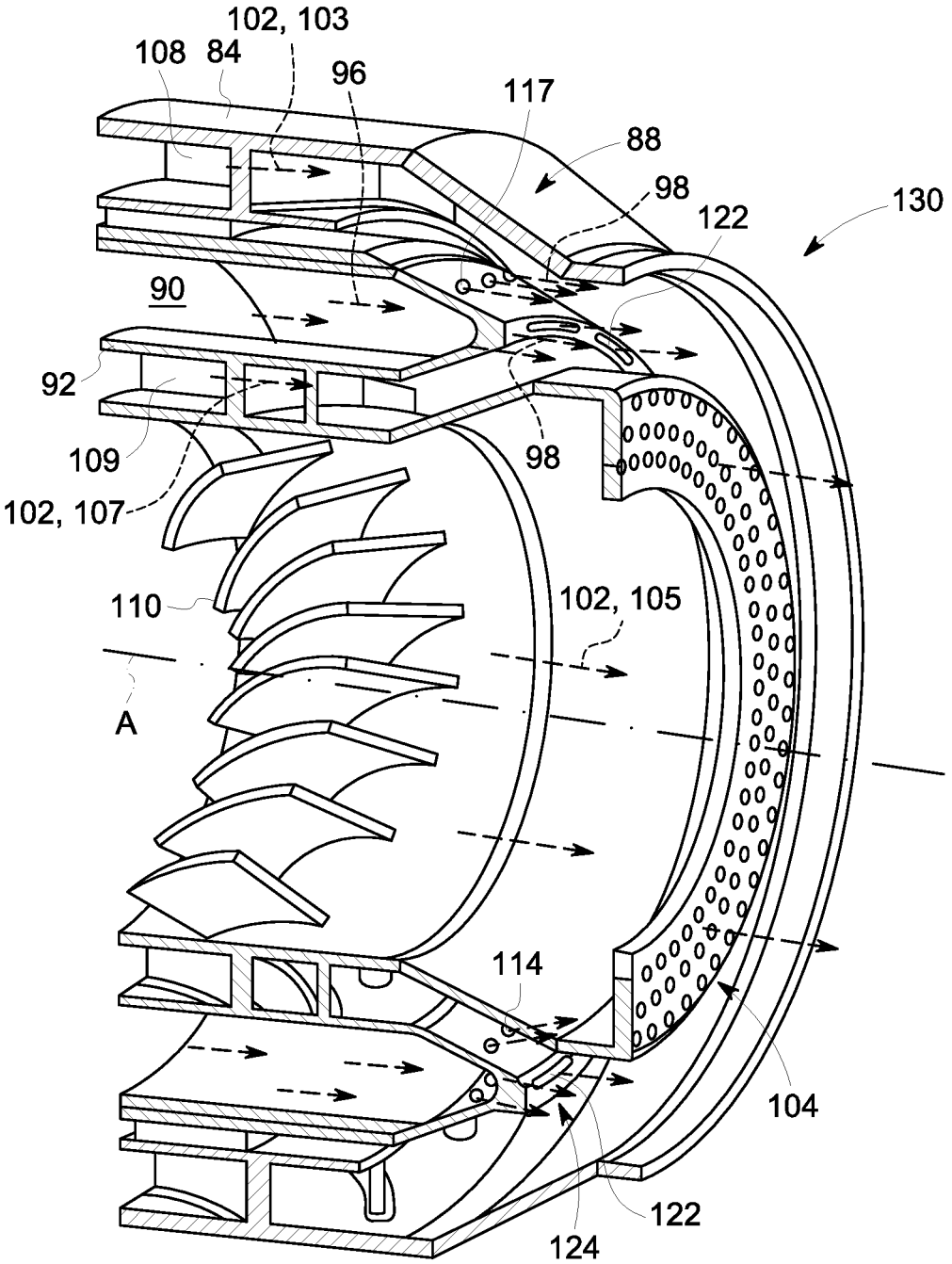
FIG. 6 is a perspective view of a portion of yet another embodiment of an exemplary fuel injection nozzle including fuel injectors that may be used with the turbine engine shown in FIG. 1, according to one or more embodiments disclosed herein.

In yet another alternate embodiment, such as illustrated in FIG. 6, a fuel injection nozzle 130, generally similar to fuel injection nozzle 82 of FIG. 3, is illustrated and includes a fuel injector 88 configured including a plurality of orifices, and more particularly intermediate orifices 114 and a plurality of outer orifices 117, defined circumferentially about an aft portion 116 of the fuel manifold 90 and a plurality of slots 122 defined circumferentially about an aft face 124 of the aft portion 116 of the fuel manifold 90. The plurality of fuel orifices 114, 117 and the plurality of fuel slots 122 are configured to provide injection of the fuel stream 96 into the outer oxidizer flow stream 103, the intermediate oxidizer flow stream 107 and the inner oxidizer flow stream 105 along a mid-plane of a downstream combustor (not shown) and away from any downstream wall, thus the potential for fuel wetting the wall is considerably reduced. Similar to the previously described embodiments, the plurality of fuel orifices 114,117 and the plurality of slots 122 are optimized such that the fuel flow 98 exiting the fuel manifold 90 undergoes initial mixing with the outer oxidizer flow stream 103 and the intermediate oxidizer flow stream 107 and subsequent circumferential and radial mixing upon its interaction with the inner oxidizer flow stream 105, thereby producing high mixing efficiency at an exit plane 104 of the nozzle 130.

Figure 7:
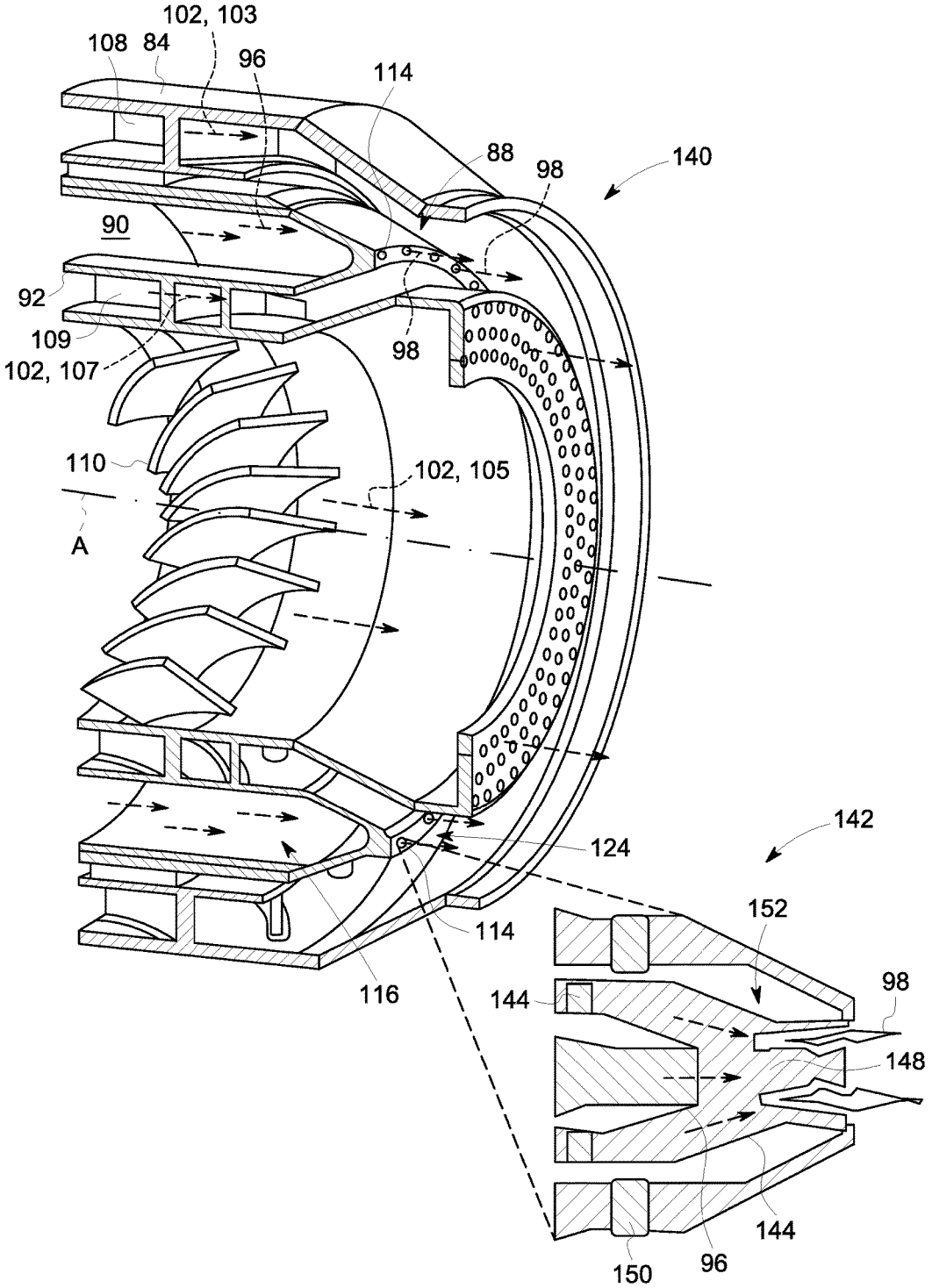
FIG. 7 is a perspective view of a portion of another alternate embodiment of an exemplary fuel injection nozzle including fuel injectors and an enlargement of an injector tip that may be used with the turbine engine shown in FIG. 1, according to one or more embodiments disclosed herein.

Referring now to FIG. 7, illustrated is an embodiment of a fuel injector nozzle 140, generally similar to fuel injection nozzle 82 of FIG. 3. In this particular embodiment, the fuel injector nozzle 140 includes a fuel injector 88 configured including a plurality of orifices 114 defined circumferentially about an aft face 124 of an aft portion 116 of the fuel manifold 90. The plurality of fuel orifices 114 are configured to provide injection of the fuel stream 96 into the oxidizer flow stream 102 along a mid-plane of a downstream combustor (not shown) and away from any downstream wall, thus the potential for fuel wetting the wall is considerably reduced. Similar to the previously described embodiments, the plurality of fuel orifices 114 are optimized such that the fuel flow 96 exiting the fuel manifold 90 undergoes circumferential and radial mixing upon its interaction with an oxidizer flow stream 102, thereby producing high mixing efficiency at an exit plane 104 of the nozzle 120.

In contrast to the previously described embodiment, the embodiment illustrated in FIG. 7 additionally provides that one or more of the plurality of fuel orifices 114 be fitted with an injector tip 142. In an embodiment, multiple injector tips 142 may be arranged circumferentially around the aft face 142 of the fuel manifold 90. The one or more fuel injector tips 142 may be fed with a fuel manifold 144, generally similar to fuel manifold 90 that operates over a limited power range and can be switched off during operation beyond the limited range. In an embodiment, each of the one or more fuel injector tips 142 further comprises inner swirl vanes 146 in a fuel flow path 148 within the injector tip fuel manifold 144 and outer swirl vanes 150 in an air flow path 152 within the injector tip 142. The inclusion of one or more fuel injector tips 142 facilitates pressure swirl atomization for lower power applications without taking a fuel delivery pressure penalty.

In each exemplary embodiment, a fuel injector is disclosed that facilitates optimal mixing of liquid and/or gaseous fuels with oxidizer in a turbine combustor. The fuel injector provides high mixing efficiency and thus produces lower NOx emissions. In addition, the fuel injector minimizes autoignition risks since the probability of fuel wall wetting is reduced. The design of the injector and its internal flow paths include but are not limited to the location of the various fuel orifices/sheet streams, exit angles of the various fuel and oxidizer streams, exit dimensions of the various fuel orifices and annulus, shape of fuel orifices, residence time of fuel and air mixture, single or multiple fuel stream exiting the manifold.

The proposed injector design improves fuel/air mixing (compared to current fuel injector products), which consequently improves combustion efficiency, lowers $NO_x$ emissions and auto-ignition probabilities. In addition, in an embodiment the fuel injector provides wider operability, lower fuel pump pressure and increased durability. Advantageously, the fuel injector as disclosed herein requires less maintenance than know fuel injectors, results in a safer engine and weighs less than known fuel injectors, resulting in fuel cost savings.

Exemplary embodiments of a fuel injector are described in detail above. The fuel injectors are not limited to use with the specified turbine containing systems described herein, but rather, the fuel injectors can be utilized independently and separately from other turbine containing system components described herein. Moreover, the present disclosure is not limited to the embodiments of the fuel injectors described in detail above. Rather, other variations of the fuel injector embodiments may be utilized within the spirit and scope of the claims.

While the disclosure has been described in terms of various specific embodiments, those skilled in the art will recognize that the disclosure can be practiced with modification within the spirit and scope of the claims.

What is claimed is:

1. An annular fuel injection nozzle comprising:

a fuel injector housing comprising an upstream face, an opposite downstream face, and a peripheral wall extending therebetween, the fuel injector housing defined about a center longitudinal axis of the annular fuel injection nozzle;

an inner oxidizer flow path, about the center longitudinal axis, having an inner swirler therein;

an intermediate oxidizer flow path radially outward of the inner oxidizer flow path, concentric with the center longitudinal axis, having an intermediate swirler therein;

an annular fuel manifold radially outward of the intermediate oxidizer flow path, concentric with the center longitudinal axis; and an outer oxidizer flow path radially outward of the annular fuel manifold, concentric with the center longitudinal axis, having an outer swirler therein, wherein an oxidizer stream enters the fuel injector housing through the upstream face of the fuel injector housing, wherein a first portion of the oxidizer stream is diverted to the inner oxidizer flow path and through a centerbody of the fuel injection nozzle via the inner swirler as an inner oxidizer flow stream, wherein a second portion of the oxidizer stream is diverted to the intermediate oxidizer flow path via the intermediate swirler as an intermediate oxidizer flow stream, and wherein a third portion of the oxidizer stream is diverted to the outer oxidizer flow path via the outer swirler as an outer oxidizer flow stream, the annular fuel manifold comprising:

a forward portion and an aft portion including an aft face; and a plurality of fuel injector outlets defined in the aft portion, downstream of the inner swirler and the outer swirler, wherein the plurality of fuel injector outlets are configured to inject a fuel flow in a downstream direction along a mid-plane of the annular fuel manifold, wherein the mid-plane is defined as a radial median between an innermost and outermost radius of the annular fuel manifold, and wherein the fuel flow exiting the annular fuel manifold undergoes initial interaction with the intermediate oxidizer stream and the outer oxidizer stream, downstream of the intermediate swirler and the outer swirler, thereby providing a mixed stream, and wherein the mixed stream remains separated from the inner oxidizer stream until the mixed stream undergoes circumferential and radial mixing with the inner oxidizer stream, downstream of the inner swirler and the plurality of fuel injector outlets.

2. The annular fuel injection nozzle-of claim 1, wherein the plurality of fuel injector outlets are configured as a plurality of fuel exit orifices.

3. The annular fuel injection nozzle of claim 1, wherein the plurality of fuel injector outlets are configured as a plurality of fuel exit slots.

4. The annular fuel injection nozzle of claim 1, wherein the plurality of fuel injector outlets are configured circumferentially spaced about the aft portion.

5. The annular fuel injection nozzle of claim 4, wherein the plurality of fuel injector outlets are configured circumferentially spaced about the aft face.

6. The annular fuel injection nozzle of claim 1, wherein the plurality of fuel injector outlets are configured circumferentially spaced about a sidewall defining the aft portion of the annular fuel manifold and circumferentially spaced about the aft face.

7. The annular fuel injection nozzle of claim 1, wherein one or more of the plurality fuel injector outlets include a fuel injector tip to facilitate accelerating the fuel flow through the one or more of the plurality of fuel injector outlets.

8. The annular fuel injection nozzle of claim 1, wherein the inner swirler and outer swirler is a combination of radial swirlers and axial swirlers.

9. An annular fuel injection nozzle comprising:

a fuel injector housing comprising an upstream face, an opposite downstream face, and a peripheral wall extending therebetween, the fuel injector housing defined about a center longitudinal axis of the annular fuel injection nozzle;

an inner oxidizer flow path, about the center longitudinal axis, having an inner swirler therein;

an intermediate oxidizer flow path radially outward of the inner oxidizer flow path, concentric with the center longitudinal axis, having an intermediate swirler therein;

an annular fuel manifold radially outward of the intermediate oxidizer flow path, concentric with the center longitudinal axis; and an outer oxidizer flow path radially outward of the annular fuel manifold, concentric with the center longitudinal axis, having an outer swirler therein, wherein an oxidizer stream enters the fuel injector housing through the upstream face of the fuel injector housing, wherein a first portion of the oxidizer stream is diverted to the inner oxidizer flow path and through a centerbody of the fuel injection nozzle via the inner swirler as an inner oxidizer flow stream, wherein a second portion of the oxidizer stream is diverted to the intermediate oxidizer flow path via the intermediate swirler as an intermediate oxidizer flow stream, and wherein a third portion of the oxidizer stream is diverted to the outer oxidizer flow path via the outer swirler as an outer oxidizer flow stream, the annular fuel manifold comprising:

a forward portion and an aft portion including an aft face; and a plurality of fuel injector outlets configured downstream of the inner swirler and the outer swirler and circumferentially spaced about at least one of a sidewall defining the aft portion of the annular fuel manifold or downstream of the inner swirler, the intermediate swirler and the outer swirler and circumferentially spaced about an aft face of the aft portion of the annular fuel manifold, wherein the plurality of fuel injector outlets are configured to inject a fuel flow in a downstream direction along a mid-plane of the annular fuel manifold, wherein the mid-plane is defined as a radial median between an innermost and outermost radius of the annular fuel manifold, wherein the fuel flow exiting the annular fuel manifold undergoes initial interaction with the intermediate oxidizer stream and the outer oxidizer stream, downstream of the intermediate swirler and the outer swirler, thereby providing a mixed stream, wherein the mixed stream remains separated from the inner oxidizer stream until the mixed stream undergoes circumferential and radial mixing with the inner oxidizer stream passing through the inner swirler, downstream of the inner swirler and the plurality of fuel injector outlets, and wherein one or more of the plurality of fuel injector outlets comprises a plurality of fuel exit orifices, wherein at least one orifice of the plurality of fuel exit orifices is fitted with a fuel injector tip.

10. The annular fuel injection nozzle of claim 9, wherein the fuel injector tip comprises an additional fuel manifold that operates over a limited power range and is selectively operable such that the additional fuel manifold is switched off during operation beyond the limited power range.

11. The annular fuel injection nozzle of claim 9, wherein the fuel injector tip is configured to facilitate pressure swirl atomization for lower power applications without taking a fuel delivery pressure penalty.

12. A combustor assembly comprising:

a combustion liner comprising a center longitudinal axis, a forward end and an aft end; and an annular fuel injection nozzle, coupled adjacent to the forward end of the combustion liner, the annular fuel injection nozzle comprising:

a fuel injector housing comprising an upstream face, an opposite downstream face, and a peripheral wall extending therebetween, the fuel injector housing defined about the center longitudinal axis;

an inner oxidizer flow path, about the center longitudinal axis, having an inner swirler therein;

an intermediate oxidizer flow path radially outward of the inner oxidizer flow path, concentric with the center longitudinal axis, having an intermediate swirler therein;

an annular fuel manifold radially outward of the intermediate oxidizer flow path, concentric with the center longitudinal axis; and an outer oxidizer flow path radially outward of the annular fuel manifold, concentric with the center longitudinal axis, having an outer swirler therein, wherein an oxidizer stream enters the fuel injector housing through the upstream face of the fuel injector housing, wherein a first portion of the oxidizer stream is diverted to the inner oxidizer flow path and through a centerbody of the fuel injection nozzle via the inner swirler as an inner oxidizer flow stream, wherein a second portion of the oxidizer stream is diverted to the intermediate oxidizer flow path via the intermediate swirler as an intermediate oxidizer flow stream, and wherein a third portion of the oxidizer stream is diverted to the outer oxidizer flow path via the outer swirler as an outer oxidizer flow stream, the annular fuel manifold comprising:

a forward portion and an aft portion including an aft face; and a plurality of fuel injector outlets defined in the aft portion, downstream of the inner swirler and the outer swirler, wherein the plurality of fuel injector outlets are configured to inject a fuel flow in a downstream direction along a mid-plane of the annular fuel manifold, wherein the mid-plane is defined as a radial median between an innermost and outermost radius of the annular fuel manifold, wherein the fuel flow exiting the annular fuel manifold undergoes initial interaction with the intermediate oxidizer stream and the outer oxidizer stream, downstream of the intermediate swirler and the outer swirler, thereby providing a mixed stream, and wherein the mixed stream remains separated from the inner oxidizer stream until the mixed stream undergoes circumferential and radial mixing with the inner oxidizer stream passing through the inner swirler, downstream of the inner swirler and the plurality of fuel injector outlets.

13. The combustor assembly of claim 12, wherein the plurality of fuel injector outlets are configured as at least one of a plurality of fuel exit orifices and a plurality of fuel exit slots.

14. The combustor assembly of claim 12, wherein the plurality of fuel injector outlets are configured circumferentially spaced about at least one of a sidewall defining the aft portion of the annular fuel manifold and the aft face.

15. The combustor assembly of claim 12, wherein one or more of the plurality of fuel injector outlets include a fuel injector tip to facilitate accelerating the fuel flow through the one or more of the plurality of fuel injector outlets.

16. A combustor assembly comprising:

a combustion liner comprising a center longitudinal axis, a forward end and an aft end: and an annular fuel injection nozzle, coupled adjacent to the forward end of the combustion liner, the annular fuel injection nozzle comprising:

a fuel injector housing comprising an upstream face, an opposite downstream face, and a peripheral wall extending therebetween, the fuel injector housing defined about the center longitudinal axis;

an inner oxidizer flow path, about the center longitudinal axis, having an inner swirler therein;

an intermediate oxidizer flow path radially outward of the inner oxidizer flow path, concentric with the center longitudinal axis, having an intermediate swirler therein;

an annular fuel manifold radially outward of the second oxidizer flow path, concentric with the center longitudinal axis; and an outer oxidizer flow path radially outward of the annular fuel manifold, concentric with the center longitudinal axis, having an outer swirler therein, wherein an oxidizer stream enters the fuel injector housing through the upstream face of the fuel injector housing, wherein a first portion of the oxidizer stream is diverted to the inner oxidizer flow path and through a centerbody of the fuel injection nozzle via the inner swirler as an inner oxidizer flow stream, wherein a second portion of the oxidizer stream is diverted to the Intermediate oxidizer flow path via the intermediate swirler as an intermediate oxidizer flow stream, and wherein a third portion of the oxidizer stream is diverted to the outer oxidizer flow path via the outer swirler as an outer oxidizer flow stream, and the annular fuel manifold comprising:

a forward portion and an aft portion including an aft face; and a plurality of fuel injector outlets defined in the aft portion, downstream of the inner swirler and the outer swirler, wherein the plurality of fuel injector outlets are configured to inject a fuel flow in a downstream direction along a mid-plane of the annular fuel manifold, wherein the mid-plane is defined as a radial median between an innermost and outermost radius of the annular fuel manifold, wherein the fuel flow exiting the annular fuel manifold undergoes initial interaction with the intermediate oxidizer stream and the outer oxidizer stream, downstream of the intermediate swirler and the outer swirler, thereby providing a mixed stream, wherein the mixed stream remains separated from the inner oxidizer stream until the mixed stream undergoes circumferential and radial mixing upon interaction with the inner oxidizer stream downstream of the inner swirler and the plurality of fuel injector outlets, and wherein the plurality of fuel injector outlets comprises a plurality of fuel exit orifices, wherein at least one orifice of the plurality of fuel exit orifices is fitted with an injector tip, wherein the injector tip comprises an additional fuel manifold that operates over a limited power range and is selectively operable such that the additional fuel manifold is switched off during operation beyond the limited power range.

* * * * *